US008851957B2

(12) United States Patent
Naya et al.

(10) Patent No.: US 8,851,957 B2
(45) Date of Patent: Oct. 7, 2014

(54) GRINDING METHOD OF MULTIFUNCTION GRINDING MACHINE

(75) Inventors: Toshiaki Naya, Hazu-gun (JP); Kikutoshi Okada, Nagoya (JP)

(73) Assignee: JTEKT Corporation, Osaka-shi (JP)

( * ) Notice: Subject to any disclaimer, the term of this patent is extended or adjusted under 35 U.S.C. 154(b) by 683 days.

(21) Appl. No.: 13/152,888

(22) Filed: Jun. 3, 2011

(65) Prior Publication Data

US 2011/0300777 A1 Dec. 8, 2011

(30) Foreign Application Priority Data

Jun. 4, 2010 (JP) ..... 2010-128679

(51) Int. Cl.

| | |
|---|---|
| ***B24B 1/00*** | (2006.01) |
| ***B24B 51/00*** | (2006.01) |
| ***B24B 5/307*** | (2006.01) |
| ***B24B 5/01*** | (2006.01) |
| ***B24B 5/04*** | (2006.01) |
| ***B24B 27/00*** | (2006.01) |

(52) U.S. Cl.

CPC ..... *B24B 51/00* (2013.01); *B24B 5/307* (2013.01); *B24B 1/00* (2013.01); *B24B 5/01* (2013.01); *B24B 5/04* (2013.01); *B24B 27/0061* (2013.01)

USPC ..... 451/11; 451/49; 451/223

(58) Field of Classification Search

CPC ..... B24B 5/01; B24B 5/02; B24B 5/04; B24B 5/42; B24B 5/307

USPC ..... 451/11, 49, 195, 199, 210, 212, 213, 451/218, 221, 223

See application file for complete search history.

(56) References Cited

U.S. PATENT DOCUMENTS

| | | | | |
|---|---|---|---|---|
| 3,353,302 | A * | 11/1967 | Lowy | 451/142 |
| 6,685,536 | B1 * | 2/2004 | Junker | 451/5 |
| 7,083,500 | B2 * | 8/2006 | Junker | 451/10 |
| 7,147,547 | B2 * | 12/2006 | Junker | 451/57 |
| 7,393,261 | B2 * | 7/2008 | Junker | 451/5 |
| 7,708,623 | B2 * | 5/2010 | Junker | 451/402 |
| 8,475,229 | B2 * | 7/2013 | Himmelsbach | 451/11 |
| 8,579,676 | B2 * | 11/2013 | Okada et al. | 451/11 |

FOREIGN PATENT DOCUMENTS

| | | |
|---|---|---|
| JP | 51-14186 | 5/1976 |
| JP | 11-207576 | 8/1999 |

* cited by examiner

*Primary Examiner* — Maurina Rachuba

(74) *Attorney, Agent, or Firm* — Oblon, Spivak, McClelland, Maier & Neustadt, L.L.P.

(57) ABSTRACT

A grinding method includes the steps of holding a workpiece by a pair of centering members of a pair of spindle equipment, shifting two centering members to one side of a spindle rotational axis, facing a grinding wheel at the other side to the other end portion of the workpiece, grinding the other end portion of the workpiece by the grinding wheel at the other side by rotating a driving pin of the spindle equipment at one side, retracting the grinding wheel at other side and stopping the rotation of the driving pin at one side and also shifting two centering members to the other side of the spindle rotational axis, facing a grinding wheel at one side to one end portion of the workpiece, and grinding one end portion of the workpiece by the grinding wheel at one side by rotating a driving pin of the spindle equipment at the other side.

7 Claims, 7 Drawing Sheets

GRINDING METHOD OF MULTIFUNCTION GRINDING MACHINE

INCORPORATION BY REFERENCE

The present application claims priority under 35 U.S.C. §119 to Japanese Patent Application No. 2010-128679, filed on Jun. 4, 2010. The content of this application is incorporated herein by reference in the entirety.

BACKGROUND OF THE INVENTION

1. Field of the Invention

The present invention relates to a grinding method of a multifunction grinding machine grinding each of vicinities of both ends of a workpiece by each of two different grinding wheels of the multifunction grinding machine.

2. Description of the Related Art

Where a prior grinding machine grinds both end portions of a crankshaft for a combustion engine as shown in FIG. 6, it grinds a workpiece W held by a spindle equipment 120 providing a centering member 121 and a driving pin 123 and by an un-illustrated tail stock equipment providing a centering member 131.

In the prior grinding machine as shown in FIG. 6, the workpiece W is held by the centering members 121, 131 mounted oppositely on a spindle rotational axis ZW, and the driving pin is rotated around a workpiece rotational axis with being projected to the spindle rotational axis direction at an eccentric position from the spindle rotational axis ZW and engages with an adjacent crank portion Wk or a counter weight portion Ww to rotate the workpiece W around the spindle rotational axis. Therefore, the grinding wheel can not grind one end portion WTa of the workpiece at a side of driving pin but can grind the end portion WTb of the workpiece at a side of the centering member 131 of the tail stock equipment without the driving pin 123.

Since the profile of one end portion WTa of the workpiece and the profile of the other end portion WTb of the workpiece are different or a wheel slide interferes with a right or a left spindle head or with another portion of the workpiece, the prior grinding machine is prepared by two grinding machines. One grinding machine A is for grinding the one end portion WTa of the workpiece and the other grinding machine B is for grinding the other end portion WTb of the workpiece. The grinding machine A grinds the one end portion WTa of the workpiece after the workpiece W is set on the grinding machine A, then the ground workpiece is removed from the grinding machine A to be set on the grinding machine B where the other end portion WTb of the workpiece W is ground.

As another prior art, a multifunction grinding machine is provided to grind each of the one end portion WTa and the other end portion WTb of the workpiece by two kinds of the grinding wheels, a position change is required from the one end portion WTa to the other end portion WTb after grinding the one end portion WTa, then grind the other end portion WTb.

In other prior art disclosed in Japanese laid-open publication Tokkaihei 11-207576, a crankshaft is provided a female screw portion to be supported at one side by a centering member having a male screw portion engaging with the female screw portion and is supported at the other side by a centering member having no screw portion, and is rotated by a driving pin slide-able along a workpiece rotational axis direction at the other end of the workpiece. The one end portion of the crankshaft can be ground because the one end portion is supported by screw engagement mechanism. The other end portion of the crankshaft can be also ground by rotating by the screw engagement mechanism at the one side after the driving pin at the other side is moved to a position not to be engaged with the grinding wheel.

In further other prior art disclosed in Japanese Patent Tokkoushou 51-14186, it is provided first spindle head and second spindle head, each of which holds a workpiece by a chuck and supports the workpiece by a centering member, and the first and the second spindle heads are disposed oppositely. In relative to the first and the second spindle heads, each of the chucks is not moved but each of the centering members is shifted along the workpiece rotational axis with supporting the workpiece. By this construction, the further other prior art can grind the one end portion of the workpiece after holding the workpiece by the chuck at other side by shifting the centering member to the other side and can grind the other end portion of the workpiece after holding the workpiece by the chuck at one side by shifting the centering member to the one side.

The prior art disclosed in FIG. 6 needs two grinding machines grinding the one end portion and the other end portion respectively and separately. It needs much cost to prepare two grinding machines and needs floor space more to increase costs and decrease operation efficiency.

The prior multifunction grinding machine does not need two grinding machines but it needs to exchange the workpiece one to another to grind the other end portion after grinding the one end, thereby needs more operation and reduces its efficiency.

The other prior art disclosed in Japanese laid-open publication Tokkaihei 11-207576, the screw engagement mechanism drives the crankshaft when grinding the other end portion of the crankshaft, thereby to drive by small driving force so that it is possible not to drive by enough driving force.

The further other prior art disclosed in Japanese Patent Tokkoushou 51-14186, both of the first and the second spindle heads should have driving means to hold and release the chuck and rotational driving means to rotate the chuck, so that the construction is very complex.

SUMMARY OF THE INVENTION

In view of the previously mentioned circumstances, it is an object of the present invention to provide a grinding method of a multifunction grinding machine having no need to exchange one end portion to the other end portion of a workpiece and having a more simple construction to grind both of one and the other end portions.

In order to achieve the above and other objects, one aspect of the present invention provides a grinding method of a multifunction grinding machine mainly including one pair of spindle equipments to have respectively a centering member shifted along a spindle rotational axis and a driving pin rotated around the spindle rotational axis, the grinding method of the multifunction grinding machine includes mainly the steps of shifting step to one direction to shift simultaneously both of the centering members to one side of the spindle rotational axis to a position where the driving pin of the spindle equipment at one side can drive a workpiece and the driving pin of the spindle equipment at the other side can not drive the workpiece, a grinding step for the other end portion to grind the other end portion of the workpiece by sliding the grinding wheel at the other side faced to the workpiece in relative to the workpiece during rotating the workpiece by the driving pin of the spindle equipment at one side, a shifting step to the other direction to shift simultaneously both of the centering members to the other side of the spindle rotational axis to a position where the driving pin of the spindle equipment at the other side can drive the workpiece and the driving pin of the spindle equipment at one side can not drive the workpiece, a grinding step for one end portion to grind one end portion of the workpiece by sliding the grinding wheel at one side faced to the workpiece in relative to the workpiece during rotating the workpiece by the driving pin of the spindle equipment at the other side. Thereby, where the centering member is shifted to one side, the driving pin at one side is shifted to the position to be able to drive the workpiece and the driving pin at the other side is shifted to the position not to be able to drive the workpiece. Where the centering member is shifted to the other side, the driving pin at the other side is shifted to the position to be able to drive the workpiece and the driving pin at one side is shifted to the position not to be able to drive the workpiece. Thereby, the grinding method of the multifunction grinding machine has no need to exchange the one end portion to the other end portion of the workpiece and can grind both of the one end and the other end portions of the workpiece by the simple construction.

The second aspect of the present invention provides mainly the shifting step to the other direction to reduce a rotation of the driving pin of the spindle equipment at one side to slower speed than that in grinding at first when stopping the rotation of the driving pin, and to stop the rotation of the driving pin after rotating the driving pin for a predetermined number of the rotation or a predetermined time, thereby stopping in maintaining to contact the driving pin with the workpiece. Thereby, since the driving pin is stopped after it is rotated by enough slow speed rotation number or time it can positively prevent that the workpiece were apart from the driving pin and it can stop the driving pin in maintaining to contact with the workpiece, thereby preventing miss judgment of the rotational angle of the workpiece.

The third aspect of the present invention provides mainly the shifting step to the other direction to rotate the driving pin of the spindle equipment at one side over 360 degrees at slower speed than that in grinding after stopping the rotation of the driving pin, and then again to stop the rotation of the driving pin in maintaining to contact the driving pin with the workpiece. Thereby, since the driving pin is stopped again after it is rotated by enough slow speed rotation number over 360 degrees after stopping the rotation of the driving pin at first, it can positively stop the driving pin at a status contacting with the workpiece even if the workpiece were apart from the driving pin at first stopping, thereby preventing miss judgment of the rotational angle of the workpiece.

The fourth aspect of the present invention provides both of the grinding step to the other end portion and the grinding step to one end portion including to grind in a status that the driving pin of the spindle equipment at the other or one side facing to the grinding wheel is fixed at a position not to interfere with the faced grinding wheel. Thereby, it can positively prevent from interfering the driving pin with the grinding wheel.

The fifth aspect of the present invention provides the control member facing selectively one of the grinding wheel at one side and the grinding wheel at the other side to the workpiece by rotating a swing slide being mounted thereon both of the grinding wheels at the one side and the other side. Thereby, it can index to face the selected one of grinding wheels to the ground portion of the workpiece easily and simply by rotating the swing slide.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which:

FIG. 4 is a flow chart showing processing steps of the grinding method of the multifunction grinding machine.

DETAILED DESCRIPTION OF THE PREFERRED EMBODIMENTS

Figure 1A:
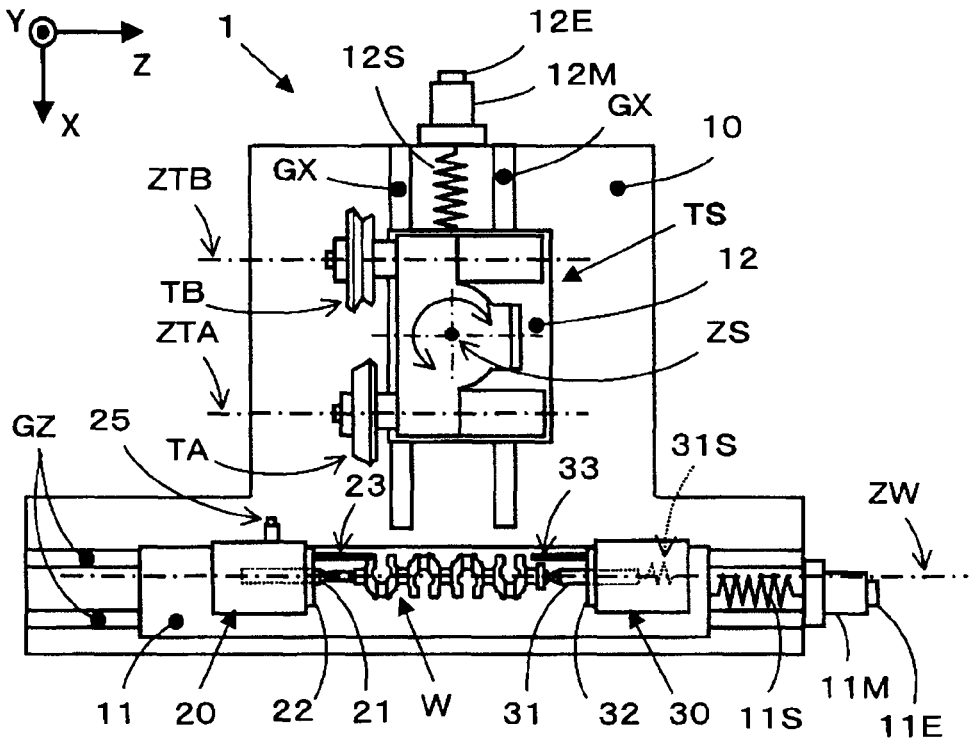
FIG. 1A is a plan view and FIG. 1B is a side view of a multifunction grinding machine 1 applied one embodiment of a grinding method of a multifunction grinding machine according to the present invention.
Figure 1B:
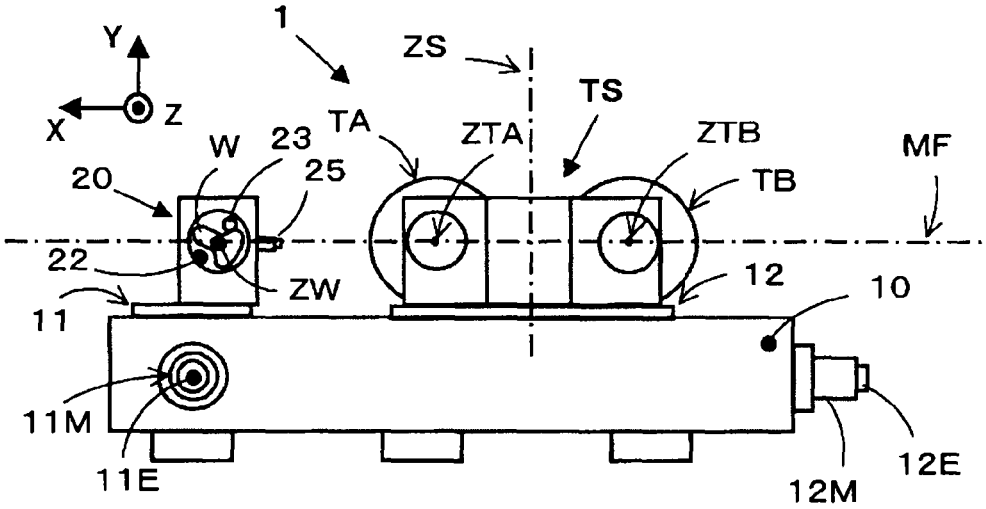

A preferred embodiment of a grinding method of a multifunction grinding machine according to the present invention will be described referring to FIG. 1 to FIG. 6. FIG. 1A is a plane diagram of a multifunction grinding machine 1 applied with the grinding method of the multifunction grinding machine according to the present invention. FIG. 1B is a side view of the multifunction grinding machine. A spindle equipment 30 at other side is eliminated in FIG. 1B.

An X-axis, a Y-axis and a Z-axis are orthogonal with each other in FIG. 1. The Y-axis shows upper vertical direction, the Z-axis shows a direction of a spindle rotational axis ZW of a spindle as a rotational axis of the workpiece W and the X-axis shows advance and retract direction of a swing slide 12.

"Construction of the Multifunction Grinding Machine 1"

The construction of the multifunction grinding machine according to the present invention will be explained hereinafter referred to FIG. 1. As shown in FIG. 1, the multifunction grinding machine 1 includes a base 10, a table 11 movable to be reciprocated along the Z-axis on the base 10, and the swing slide 12 movable to be reciprocated along the X-axis on the base 10. The swing slide 12 is swung around a swing axis ZS parallel to the Y-axis. Control means including a numerical controller controlling each of movable members are not shown.

The table 11 is reciprocated on a guide GZ along the Z-axis direction by a Z-axis driving motor 11M and a feed screw 11S. The control means output a control signal to the Z-axis driving motor 11M in keeping to receive a detecting signal from position detecting means 11E such as an encoder to position the table 11 along the Z-axis.

The swing slide 12 is reciprocated on a guide GX along the X-axis direction by an X-axis driving motor 12M and a feed screw 12S. The control means output a control signal to the X-axis driving motor 12M in keeping to receive a detecting signal from a position detecting means 12E such as an encoder to position the swing slide 12 along the X-axis.

On the table 11 are mounted a spindle equipment 20 at one side and the spindle equipment 30 at the other side of the table 11. The spindle equipments 20, are reciprocated along the Z-axis on the table and able to hold various type of the workpiece W.

The spindle equipment 20 at one side includes a centering member 21, a spindle 22, a driving pin 23 and a truing apparatus 25. The centering member 21 is accommodated in a spindle housing rotatably as a live center or non-rotatably as a dead center on the spindle rotational axis ZW to be positioned on the spindle rotational axis ZW and is shifted in relative to the spindle equipment 20 along the spindle rotational axis ZW. The spindle 22 is mounted in the spindle housing rotatably around the spindle rotational axis ZW by an un-illustrated motor. The driving pin 23 is rotated around the spindle rotational axis ZW by the un-illustrated motor and mounted on the spindle 22 to be projected along the spindle rotational axis ZW at eccentric position of a predetermined distance from the spindle rotational axis ZW. The driving pin 23 is rotated near a periphery of the center member 21 when the spindle 22 is rotated, and the driving pin 23 rotates the workpiece W around the spindle rotational axis ZW after the driving pin 23 engages with the workpiece W, in other words interferes in a rotational direction. The control means rotate the spindle 22 at a certain angle velocity until a certain angle.

The spindle equipment 30 at the other side includes a centering member 31, a spindle 32 and a driving pin 33. The centering member 31 is mounted in a spindle housing rotatably as a live center or non-rotatably as a dead center on the spindle rotational axis ZW to be positioned on the spindle rotational axis ZW opposite to the centering member 21 and is shifted in relative to the spindle equipment 30 along the spindle rotational axis ZW. The centering member 31 is urged by an elastic member 31S to hold the workpiece W with a predetermined force. The spindle 32 is rotated around the spindle rotational axis ZW by an un-illustrated motor. The driving pin 33 is rotated around the spindle rotational axis ZW by the un-illustrated motor and mounted on the spindle 32 to be projected along the spindle rotational axis ZW at eccentric position of a predetermined distance from the spindle rotational axis ZW. The driving pin 33 is rotated near a periphery of the center member 31 when the spindle 32 is rotated, and the driving pin 33 rotates the workpiece W around the spindle rotational axis ZW after the driving pin 23 engages with the workpiece W, in other words interferes in a rotational direction. The control means rotate the spindle 32 at a certain angle velocity until a certain angle.

Where the centering member 21 and the centering member 31 are mounted at opposed position each other on the spindle rotational axis ZW to hold the workpiece W, the workpiece W is ground by a grinding wheel TA at one side or a grinding wheel TB at the other side.

On a grinding wheel apparatus TS including the swing slide 12 is mounted an un-illustrated swing motor near a center of the swing slide 12. The control means output a control signal to the swing motor in keeping to detect a signal from an angle detecting means such as an encoder in order to control a swing angle of the swing slide 12.

On the swing slide 12 are mounted the grinding wheel TA at one side and the grinding wheel TB at the other side surrounding the swing motor. The grinding wheel TA at one side is driven around a grinding wheel rotational axis ZTA and the grinding wheel TB at the other side is driven around a grinding wheel rotational axis ZTB. The grinding wheel rotational axis ZTA at one side and the grinding wheel rotational axis ZTB at the other side are parallel each other and orthogonal to the swing axis ZS. By the above construction, the control means control to index selectively one of the grinding wheels TA, TB to face to a ground portion of the workpiece W by controlling the swing angle of the swing slide 12.

While the grinding wheel rotational axis ZTA at one side and the grinding wheel rotational axis ZTB at the other side are mounted at the same left side of end portion of the swing slide 12 along the same direction as shown in FIG. 1, however, they may be mounted at an opposite side along the different direction each other or mounted at an opposite side of the same spindle as a twin holding. The grinding wheel rotational axis ZTA at one side and the grinding wheel rotational axis ZTB at the other side may be also mounted on different axes not being parallel.

The multifunction grinding machine 1 includes an un-illustrated coolant nozzle supplying coolant to a grinding point of each of the grinding wheels to the cylindrical workpiece W.

Figure 3A:
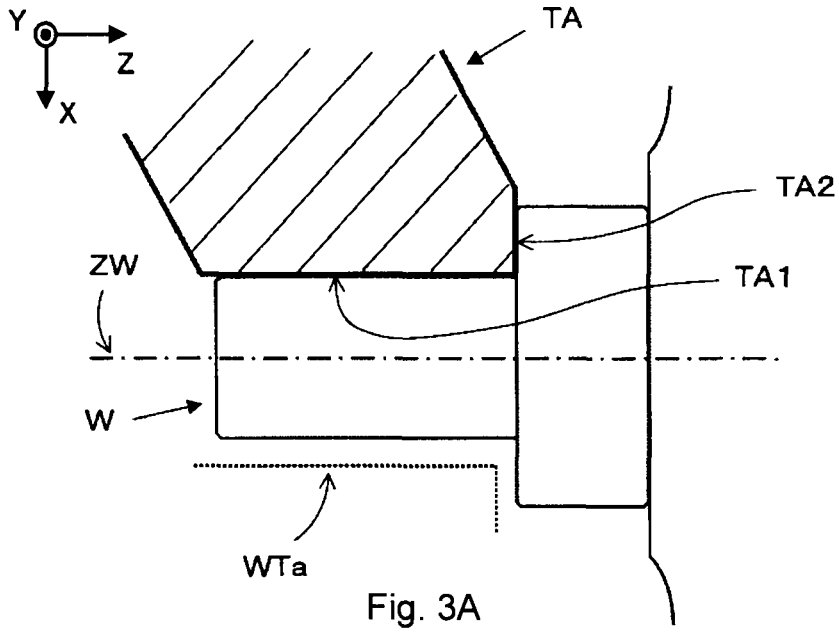
FIG. 3A is an enlarged diagram of grinding the status of grinding one end portion WTa of the workpiece W and FIG. 3B is an enlarged diagram explaining the status of grinding the other end portion WTb of the workpiece W.

The grinding wheel TA at one side includes two kinds of grinding surfaces TA1, TA2 shown in FIG. 3A. Each tangent to two grinding surfaces TA1, TA2 is respectively inclined to the grinding wheel rotational axis ZTA at one side, so that each of two grinding surfaces TA1, TA2 is conical to be able to grind simultaneously both of a cylindrical surface and an end surface of the workpiece W near its one end portion WTa. The cylindrical surface of the workpiece W is parallel to the spindle rotating axis ZW and the end surface of the workpiece W is orthogonal to the spindle rotating axis ZW.

Figure 3B:
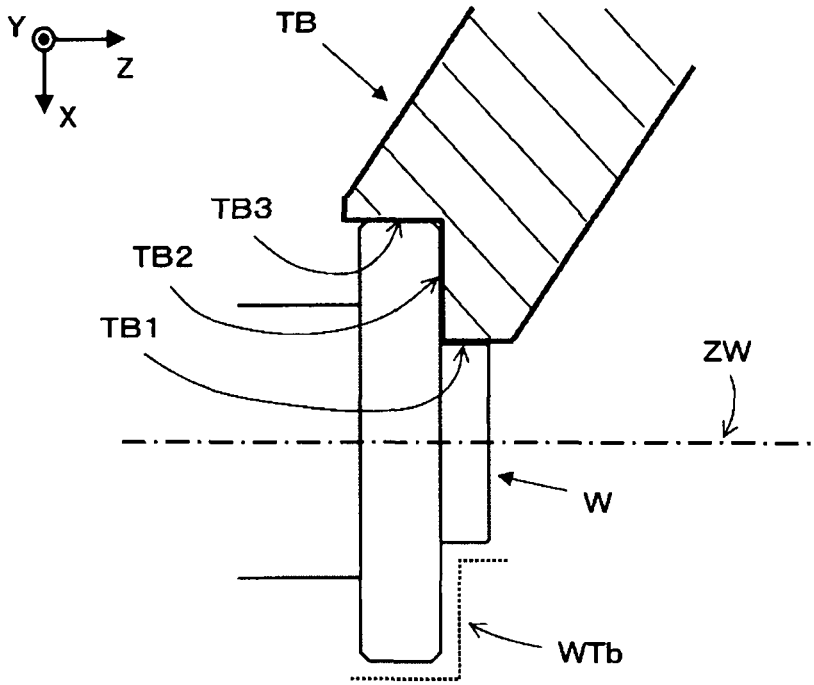

The grinding wheel TB at the other side includes three kinds of grinding surfaces TB1, TB2, TB3 shown in FIG. 3B. Each tangent to three grinding surfaces TB1, TB2, TB3 is respectively inclined to the grinding wheel rotational axis ZTB at the other side, so that each of three grinding surfaces TB1, TB2, TB3 is conical to be able to grind simultaneously two cylindrical surfaces and one end surface of the workpiece W near its the other end portion WTb.

In order to practice the above-identified two grinding processes, the control means index selectively one of the grinding wheels TA, TB to face to one of the one end portion WTa and the other end portion WTb of the workpiece W by controlling the swing angle of the swing slide 12.

A profile of the grinding wheel is not limited to the above-identified construction, it may use various kind of shape according to the profile of the workpiece at its end portions. In a case the profile at the end portions are identical, it may use the same profile of the grinding wheels TA, TB.

An un-illustrated sizing device detecting a diameter of the workpiece W is mounted on the table 11 or the base 10 in the multifunction grinding machine 1.

The spindle rotational axis ZW, the grinding wheel rotational axis ZTA at one side, the grinding wheel rotational axis ZTB at the other side and the truing device 25 are disposed on a relative moving plane MF orthogonal to the swing axis ZS.

Figure 2A:
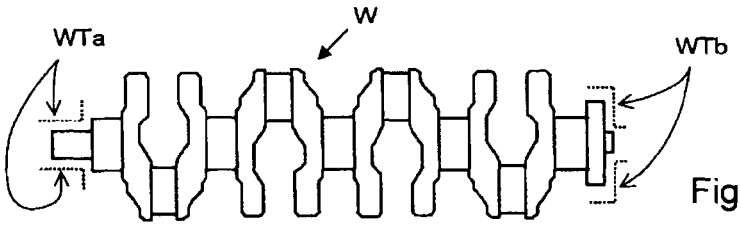
FIG. 2A is a schematic view of a crankshaft as a workpiece W.

One example of the profile of the workpiece W and a status of grinding by each grinding wheel will be explained hereinafter referred to FIG. 2 and FIG. 3.

The workpiece W according to the embodiment of the present invention is a crankshaft for a combustion engine and has cylindrical profiles at both axial ends. Each of the cylindrical profiles is different respectively between profiles at one end portion WTa and the other end portion WTb of the workpiece W.

Figure 2B:
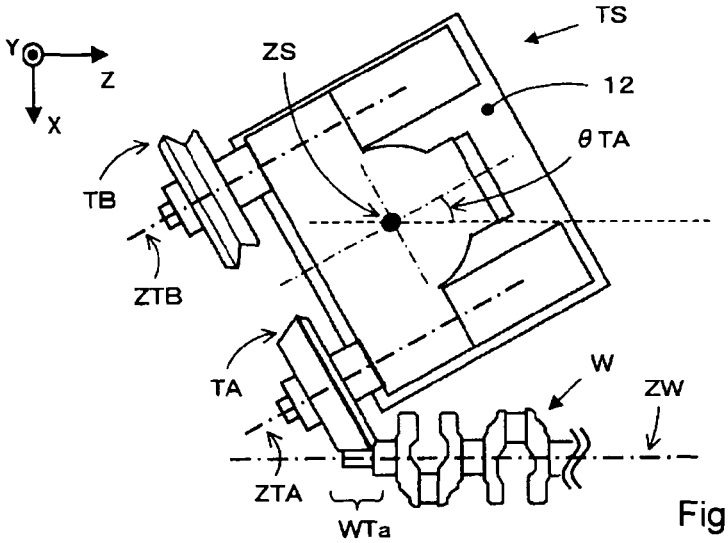
FIG. 2B is an explanatory diagram explaining a status of grinding one end portion WTa of the workpiece W and FIG. 2C is an explanatory diagram explaining a status of grinding the other end portion WTb of the workpiece W.

As shown in FIG. 3A, the grinding surfaces TA1, TA2 grind one end portion WTa of the workpiece W after the swing slide 12 of the grinding wheel apparatus TS is rotated at an angle θTA from the status shown in FIG. 1 to the status shown in FIG. 2B to face selectively the grinding surfaces TA1, TA2 of the grinding wheel TA at one side to one end portion WTa of the workpiece W.

Figure 2C:
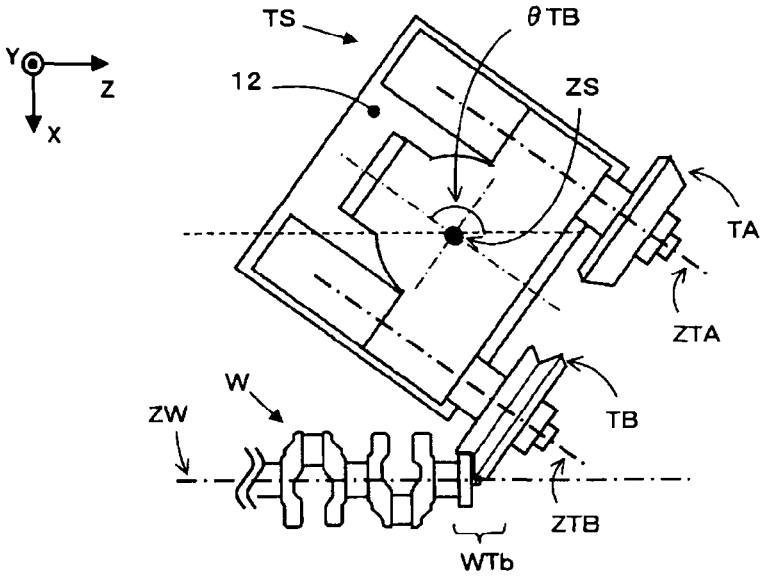

As shown in FIG. 3B, the grinding surfaces TB1, TB2, TB3 grind the other end portion WTb of the workpiece W after the swing slide 12 of the grinding wheel apparatus TS is rotated at an angle θTB from the status shown in FIG. 1 to the status shown in FIG. 2C to face selectively the grinding surfaces TB1, TB2, TB3 of the grinding wheel TB at the other side to the other end portion WTb of the workpiece W.

"Operation and Operation Step of the Multifunction Grinding Machine 1"

Figure 4A:
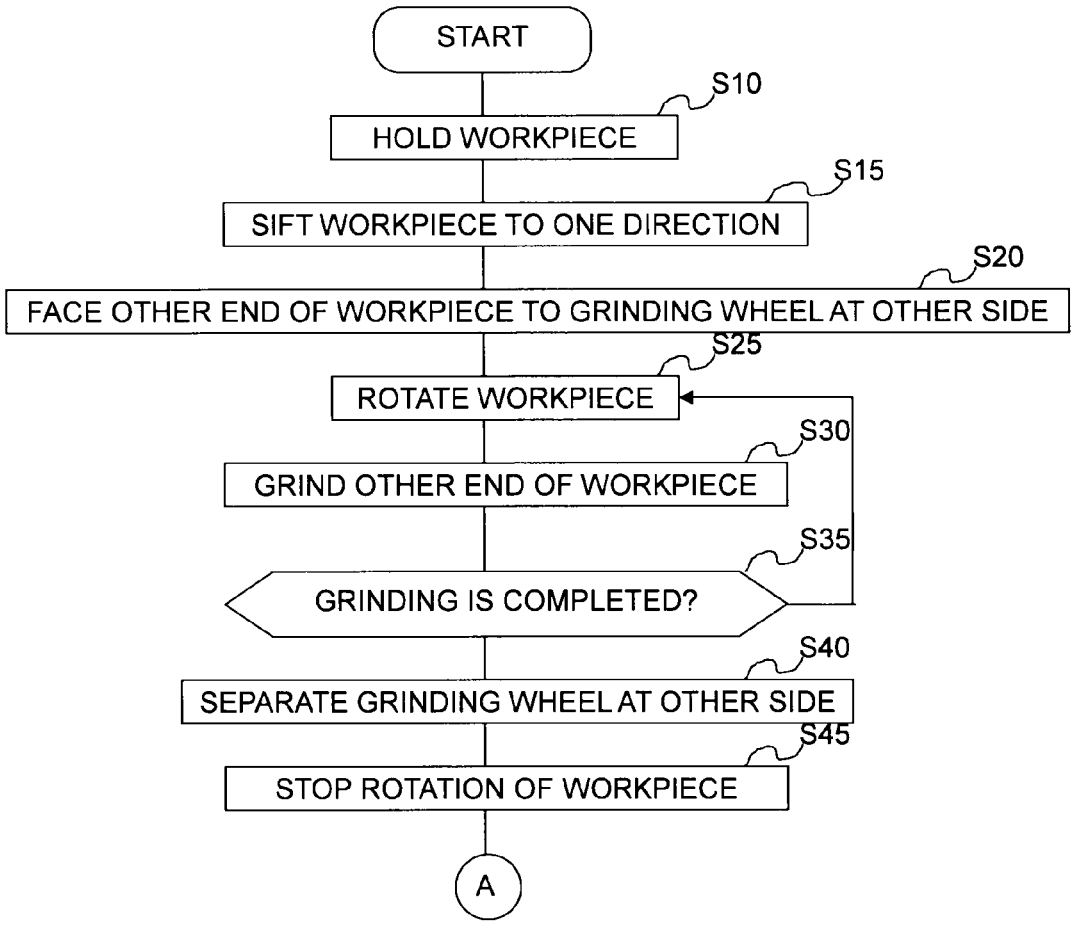
FIG. 4A is first part of the flow chart and FIG. 4B is second and last part of the flow chart continuing from the first part.
Figure 4B:
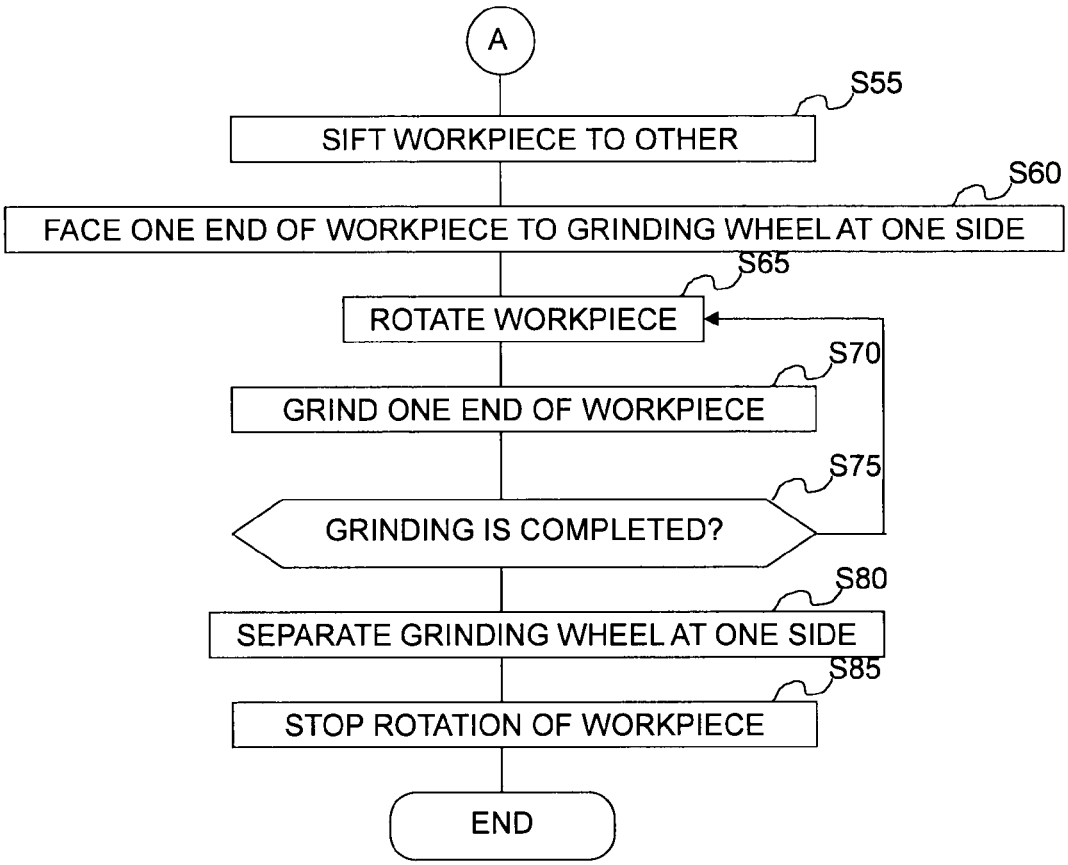

The operation step and the operation will be explained referred to a flow chart shown in FIG. 4 and an operation status shown in FIG. 5.

Where one end portion WTa and the other end portion WTb of the workpiece W will be ground, the workpiece W is temporally placed on temporal receivers and an operator operates an operating box of the control means to start the grinding cycle, thereby the operation shown in FIG. 4 is started.

Figures 5A, 5B, 5C, 5D, 5E:
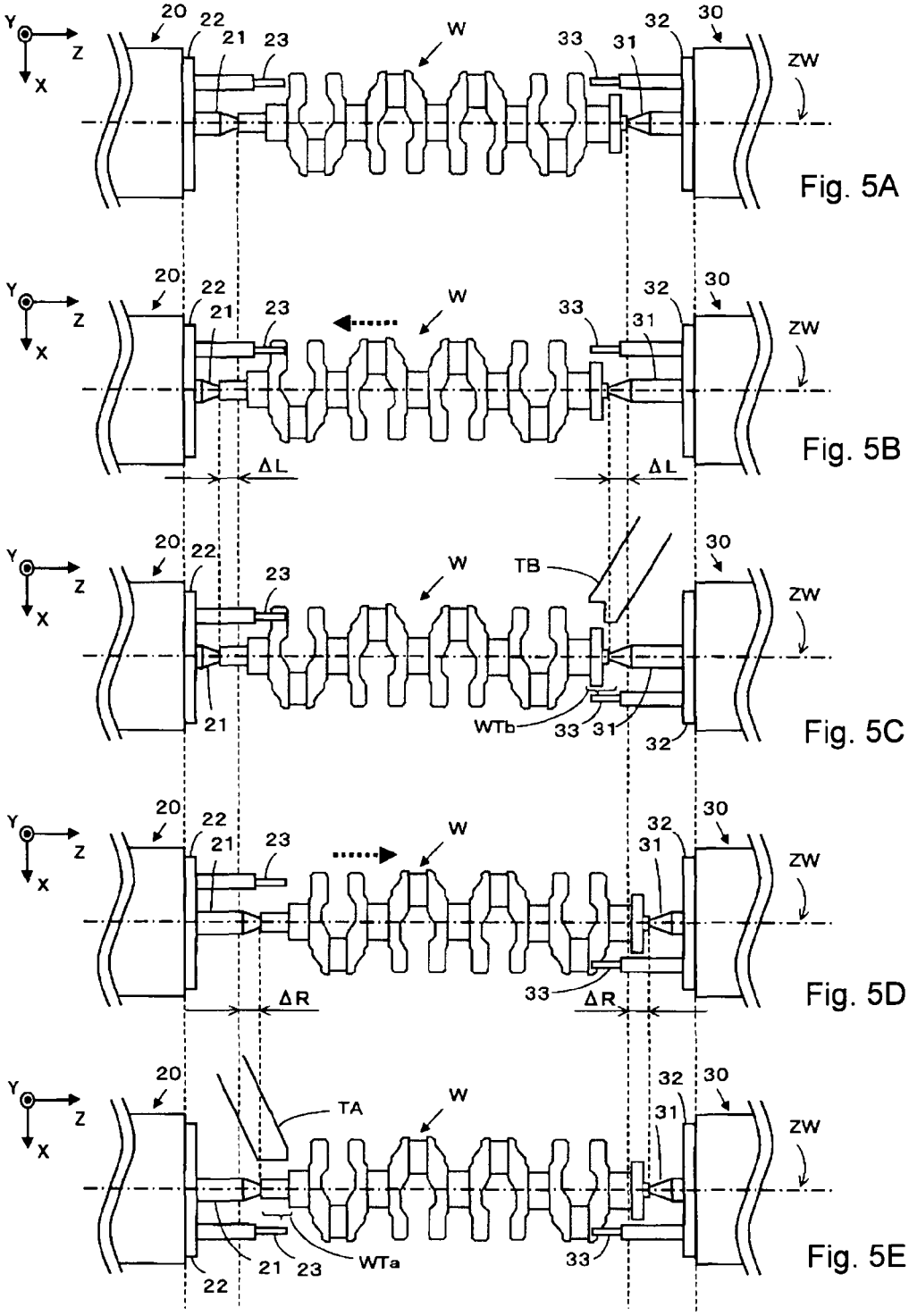
FIG. 5 is an explanatory diagram explaining operation etc. of the workpiece W, a spindle equipment 20 at one side, a spindle equipment 30 at the other side, a grinding wheel TB for one end portion of the workpiece W and a grinding wheel TA for the other end portion of the workpiece W in operation steps of the grinding method of the multifunction grinding machine.
Figure 6:
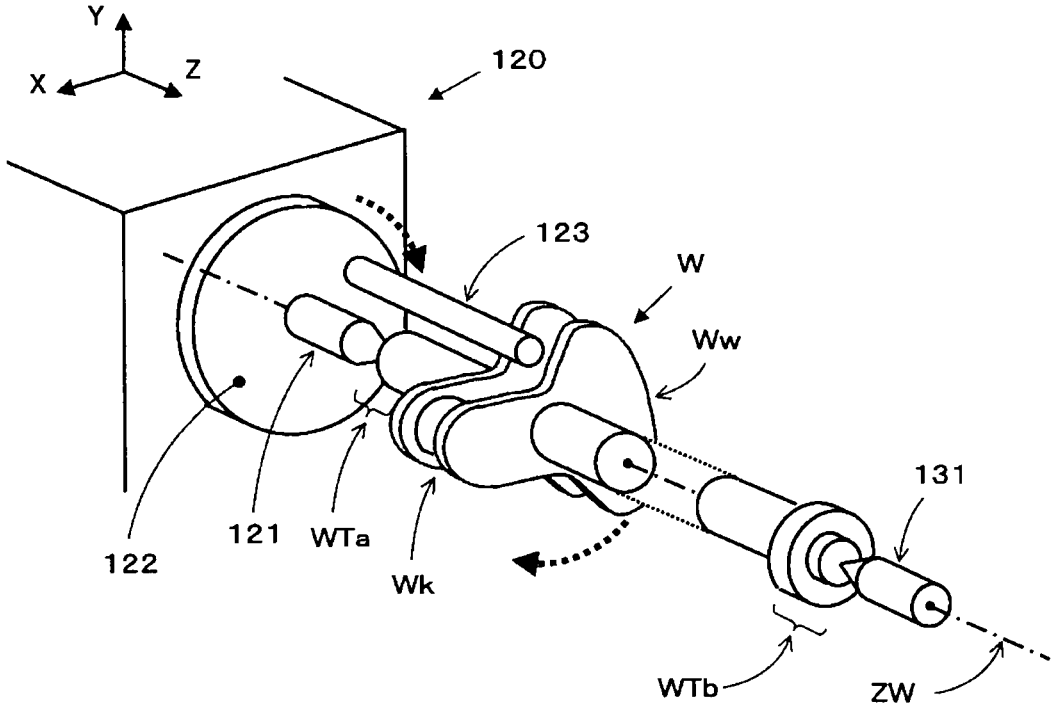
FIG. 6 is an explanatory diagram showing a status rotating by a driving pin 123 the workpiece W held by both of centering members 121, 131 in the prior art.

In Step 10 of holding the workpiece W, the control means command to hold the workpiece W received on the temporal receivers by the centering members 21, 31 disposed oppositely, then to progress to Step 15. FIG. 5A shows the status holding the workpiece W by the centering members 21, 31.

In Step 15 of sifting the workpiece W to one direction, the control means command to shift the centering member 21 at the predetermined distance ΔL to one direction of a leftward direction in FIG. 5 in order to shift the workpiece W urged and held by the spring force of the centering member 31. As a result the centering members 21, 31 are shifted simultaneously along the Z-axis however the spindle 22, the driving pin 23 and the spindle 32, the driving pin 33 are not shifted but maintained in their positions in the Z-axis direction. The operation status is shown in FIG. 5B. The workpiece W is shifted at the predetermined distance ΔL to a position where it is able to be driven by the driving pin 23 of the spindle equipment 20 at one side in other word to be interfered at a rotational direction and it is not able to driven by the driving pin 33 of the spindle equipment 30 at the other side in other word not to be interfered at a rotational direction.

In Step 20 of facing to the other grinding wheel, the control means command to rotate the swing slide 12 of the grinding wheel device TS at the angle θTB shown in FIG. 2C and to adjust the swing slide 12 along the X-axis direction and the table 11 along the Z-axis direction in order to face the grinding wheel TB at the other side to the other end portion WTb of the workpiece W. The driving pin 33 is rotated to a position not to interfere with the grinding wheel TB at the other side by rotating the spindle 32. The operation status is shown in FIG. 5C.

In Step 25, the control means command to rotate the driving pin 23 of the spindle equipment 20 at one side in order to rotate the workpiece W around the spindle rotating axis ZW. The driving pin 33 at other side is stopped at the fixed rotational angular position not interfered with the grinding wheel TB at the other side. The centering member 31 in a live center is rotated with the workpiece W in relative to the spindle 32 or the centering member 31 in a dead center is not rotated but the workpiece W is slid against the centering member 31.

In Step 30, the control means command to grind the other end portion WTb of the workpiece W by moving the grinding wheel TB at the other side relatively to the workpiece W along the X-axis and the Z-axis. The operation status in Steps 25, 30 is also shown in FIG. 5C.

In Step 35, the control means judge whether a size of the other end portion WTb of the ground workpiece W reaches to a predetermined value or not in a way of measuring by the un-illustrated sizing device. The predetermined value is reached in other word in a "Yes" condition to progress to next Step 40 but the predetermined value is not yet reached in other word in a "No" condition to return to Step 30. Above Step 25 to Step 35 correspond to a step grinding the other end portion.

In Step 40, the control means command to retract the grinding wheel TB at the other side from the workpiece W.

In Step 45, the control means command to stop the rotation of the driving pin 23 and the workpiece W. It is not so good in general to stop the rotation of the workpiece W suddenly. The crankshaft has a balancing weight portion at the opposite side of a crankpin in order to stabilize the rotation of the crankshaft so that inertia of the rotation is quite large. When the rotation of the crankshaft is stopped the crankshaft still tends to rotate for a while by its inertia. Therefore, it tends that the crankshaft is stopped at forward position from the position of the stopped driving pin 23, in other words the driving pin 23 is stopped at the position apart from the workpiece W. The control means tend to miss to recognize the actual position of the workpiece W, so that there happens to make the driving pin 33 interfere with the workpiece W at the other side in the rotational angle direction where the workpiece W is shifted to the other direction in next Step 55.

Therefore, in Step 45 of the one embodiment according to the present invention, the rotation of the driving pin 23 of the spindle equipment 20 at one side is stopped after the driving pin 23 is rotated with slower rotational speed than that in grinding for a predetermined number of rotation or a predetermined time. By this operation, it is prevented that the workpiece W is stopped at apart from the driving pin 23 by its inertia.

It may be operated that the driving pin 23 of the spindle equipment 20 at one side is rotated with the slower rotational speed over 360 degrees than that in grinding after the rotation of the driving pin 23 is stopped, thereby the driving pin 23 is firmly engaged with the workpiece W and then stopped. Even though the rotation is at first stopped with the driving pin 23 apart from the workpiece W, the driving pin 23 is re-engaged with the workpiece W at slower speed and then stopped in order to prevent the driving pin 23 from separating from the workpiece W.

In Step 55, the control means command to shift the centering member 21 at the predetermined distance ΔR to the other direction of a rightward direction in FIG. 5 in order to shift the workpiece W urged and held by the spring force of the centering member 31. As a result the centering members 21, 31 are shifted simultaneously along the Z-axis however the spindle 22, the driving pin 23 and the spindle 32, the driving pin 33 are not shifted but maintained in their positions in the Z-axis direction. The operation status is shown in FIG. 5D. The workpiece W is shifted at the predetermined distance ΔR to a position where it is able to be driven by the driving pin 33 of the spindle equipment 30 at the other side in other word to be interfered at a rotational direction and it is not able to driven by the driving pin 23 of the spindle equipment 20 at the one side in other word not to be interfered at a rotational direction. Above Step 40 to Step 55 correspond to a step shifting the other end portion.

In Step 60 of facing to the one grinding wheel, the control means command to rotate the swing slide 12 at the angle θTA shown in FIG. 2B and to adjust the swing slide 12 along the X-axis direction and the table 11 along the Z-axis direction in order to face the grinding wheel TA at the one side to the one end portion WTa of the workpiece W. The driving pin 23 is rotated to a position not to interfere with the grinding wheel TA at the one side by rotating the spindle 22. The operation status is shown in FIG. 5E.

In Step 65, the control means command to rotate the driving pin 33 of the spindle equipment 30 at the other side in order to rotate the workpiece W around the spindle rotating axis ZW. The driving pin 23 at one side is stopped at the fixed rotational angular position not interfered with the grinding wheel TA at one side. The centering member 21 in a live center is rotated with the workpiece W in relative to the spindle 22 or the centering member 21 in a dead center is not rotated but the workpiece W is slid in relative to the centering member 21.

In Step 70, the control means command to grind the other end portion WTa of the workpiece W by moving the grinding wheel TA at one side relatively to the workpiece W along the X-axis and the Z-axis. The operation status in Steps 65, 70 is also shown in FIG. 5E.

In Step 75, the control means judge whether a size of one end portion WTa of the ground workpiece W reaches to a predetermined value or not in a way of measuring by the un-illustrated sizing device. The predetermined value is reached in other word in a "Yes" condition to progress to next Step 80 but the predetermined value is not yet reached in other word in a "No" condition to return to Step 70. Above Step 65 to Step 75 correspond to a step grinding one end portion.

In Step 80, the control means command to retract the grinding wheel TA at one side from the workpiece W.

In Step 85, the control means command to stop the rotation of the driving pin 23 and the workpiece W. The workpiece W ground the both end portions is released from the centering members 21, 31 to be placed on the temporal receiver, then the operation is ended.

The one embodiment of the grinding method of the multifunction grinding machine according to the present invention can grind both of one end portion WTa and the other end portion WTb of the workpiece W without switching the workpiece W from one end portion to the other end portion by rotating the workpiece at 180 degrees, thereby it needs few steps and improves the operation efficiency. There is no need to provide a pair of chucks controlling to hold and release the workpiece and to rotate the workpiece, the one embodiment includes only two simple driving pins 23, 33 projecting to the spindle rotational axis direction, thereby to provide the simple construction. It may be provided that two wheel slides is moved in relative to the base along to the X-axis and the Z-axis directions instead of the swing slide.

While the invention has been described in detail with reference to the preferred embodiment, it will be apparent to those skilled in the art that the invention is not limited to the present embodiment, and that the invention may be realized in various other embodiments within the scope of the claims.

For example, while the grinding method of the multifunction grinding machine is applied to the multifunction grinding machine 1 described above, however the present invention is not limited to the construction, but it may be applied to various types of the multifunction grinding machine.

While the present invention is described by the multifunction grinding machine 1 having the grinding wheel device TS moved along the X-axis and the table 11 moved along the Z-axis, however it may be the grinding wheel device TS moved in relative to the workpiece W to the X-axis and the Z-axis directions.

While the crankshaft is explained as the workpiece W in the one embodiment, however it may use various kinds of workpiece being able to be driven by the driving pin.

What is claimed is:

1. A grinding method of a multifunction grinding machine grinding predetermined positions of a workpiece by a plurality of grinding wheels during driving said workpiece by driving pins contacting with said workpiece, said multifunction grinding machine including a pair of spindle equipment, each of said pair of spindle equipment includes a centering member accommodated in a spindle housing and shifted along a spindle rotational axis in relative to said spindle housing, and a driving pin mounted on a spindle in said spindle housing to be rotated around said spindle rotational axis at a position of a predetermined distance from said spindle rotational axis and projected along said spindle rotational axis direction, said pair of spindle equipment are disposed in a way that said centering members are oppositely faced each other; a grinding wheel at one side grinding one end portion of said workpiece and; a grinding wheel at the other side grinding the other end portion of said workpiece, said grinding method comprising:

a holding step to hold said workpiece by said centering members of said one pair of spindle equipment;

a shifting step to one direction to shift simultaneously both of said centering members to one side of said spindle rotational axis to a position where said driving pin of said spindle equipment at one side can drive said workpiece and said driving pin of said spindle equipment at the other side cannot drive said workpiece in maintaining to hold said workpiece by said two centering members;

a facing step to said other grinding wheel to face said grinding wheel at the other side to the other end portion of said workpiece;

a grinding step for the other end portion to rotate said workpiece by rotating said driving pin of said spindle equipment at one side, and to grind the other end portion of said workpiece by sliding said grinding wheel at the other side faced to said workpiece in relative to said workpiece;

a shifting step to the other direction to retract said grinding wheel at the other side from said workpiece, to stop the rotation of said driving pin of said spindle equipment at one side, and to shift simultaneously both of said centering members to the other side of said spindle rotational axis to a position where said driving pin of said spindle equipment at the other side can drive said workpiece and said driving pin of said spindle equipment at one side cannot drive said workpiece;

a facing step to said one grinding wheel to face said grinding wheel at one side to one end portion of said workpiece; and a grinding step for one end portion to rotate said workpiece by rotating said driving pin of said spindle equipment at the other side, and to grind one end portion of said workpiece by sliding said grinding wheel at the one side faced to said workpiece in relative to said workpiece.

2. The grinding method of a multifunction grinding machine according to claim 1, wherein said shifting step to the other direction includes to reduce a rotation of said driving pin of said spindle equipment at one side to slower speed than that in grinding at first when stopping said rotation of said driving pin, and to stop said rotation of said driving pin after rotating said driving pin for a predetermined number of said rotation or a predetermined time, thereby stopping in maintaining to contact said driving pin with said workpiece.

3. The grinding method of a multifunction grinding machine according to claim 1, wherein said shifting step to the other direction includes to rotate said driving pin of said spindle equipment at one side over 360 degrees at slower speed than that in grinding after stopping said rotation of said driving pin, and then again to stop said rotation of said driving pin in maintaining to contact said driving pin with said workpiece.

4. The grinding method of a multifunction grinding machine according to claim 1, wherein both of said grinding step to the other end portion and said grinding step to one end portion include to grind in a status that said driving pin of said spindle equipment at the other or one side facing to said grinding wheel is fixed at a position not to interfere with said faced grinding wheel.

5. The grinding method of a multifunction grinding machine according to claim 1, wherein said control member faces selectively one of said grinding wheel at one side and said grinding wheel at the other side to said workpiece held by said centering members of said one pair of spindle equipment by rotating a swing slide being mounted thereon both of said grinding wheels at the one side and the other side.

6. A grinding method of a multifunction grinding machine grinding predetermined positions of a workpiece by a plurality of grinding wheels during driving said workpiece by driving pins contacting with said workpiece, said multifunction grinding machine including a pair of spindle equipment, each of said pair of spindle equipment includes a centering member accommodated in a spindle housing and shifted along a spindle rotational axis in relative to said spindle housing, and a driving pin mounted on a spindle in said spindle housing to be rotated around said spindle rotational axis at a position of a predetermined distance from said spindle rotational axis and projected along said spindle rotational axis direction, said pair of spindle equipment are disposed in a way that said centering members are oppositely faced each other; a grinding wheel at one side grinding one end portion of said workpiece; and a grinding wheel at the other side grinding the other end portion of said workpiece, said grinding method comprising:

a holding step to hold said workpiece by said centering members of said one pair of spindle equipment;

a shifting step to one direction to shift simultaneously both of said centering members to one side of said spindle rotational axis to a position where said driving pin of said spindle equipment at one side can drive said workpiece and said driving pin of said spindle equipment at the other side cannot drive said workpiece in maintaining to hold said workpiece by said two centering members;

a facing step to said other grinding wheel to face said grinding wheel at the other side to the other end portion of said workpiece;

a grinding step for the other end portion to rotate said workpiece by rotating said driving pin of said spindle equipment at one side, and to grind the other end portion of said workpiece by sliding said swing slide with said grinding wheel at the other side faced to said workpiece in relative to said workpiece in a status that said driving pin of said spindle equipment at the other side facing to the grinding wheel is fixed at a position not to interfere with said faced grinding wheel;

a shifting step to the other direction to retract said swing slide with said grinding wheel at the other side from said workpiece, to stop the rotation of said driving pin of said spindle equipment at one side, and to shift simultaneously both of said centering members to the other side of said spindle rotational axis to a position where said driving pin of said spindle equipment at the other side can drive said workpiece and said driving pin of said spindle equipment at one side cannot drive said workpiece;

said shifting step to the other direction includes to reduce a rotation of said driving pin of said spindle equipment at one side to slower speed than that in grinding at first when stopping said rotation of said driving pin, and to stop said rotation of said driving pin after rotating the driving pin for a predetermined number of said rotation or a predetermined time, thereby stopping in maintaining to contact said driving pin with said workpiece;

a facing step to said one grinding wheel to face said grinding wheel at one side to one end portion of said workpiece; and a grinding step for one end portion to rotate said workpiece by rotating said driving pin of said spindle equipment at the other side, and to grind one end portion of said workpiece by sliding said swing slide with said grinding wheel at the one side faced to said workpiece in relative to said workpiece in a status that said driving pin of said spindle equipment at one side facing to the grinding wheel is fixed at a position not to interfere with said faced grinding wheel.

7. A grinding method of a multifunction grinding machine grinding predetermined positions of a workpiece by a plurality of grinding wheels during driving said workpiece by driving pins contacting with said workpiece, said multifunction grinding machine including a pair of spindle equipment, each of said pair of spindle equipment includes a centering member accommodated in a spindle housing and shifted along a spindle rotational axis in relative to said spindle housing, and a driving pin mounted on a spindle in said spindle housing to be rotated around said spindle rotational axis at a position of a predetermined distance from said spindle rotational axis and projected along said spindle rotational axis direction, said pair of spindle equipment are disposed in a way that said centering members are oppositely faced each other; a grinding wheel at one side grinding one end portion of said workpiece; and a grinding wheel at the other side grinding the other end portion of said workpiece, said grinding method comprising:

a holding step to hold said workpiece by said centering members of said one pair of spindle equipment;

a shifting step to one direction to shift simultaneously both of said centering members to one side of said spindle rotational axis to a position where said driving pin of said spindle equipment at one side can drive said workpiece and said driving pin of said spindle equipment at the other side cannot drive said workpiece in maintaining to hold said workpiece by said two centering members;

a facing step to said other grinding wheel to face said grinding wheel at the other side to the other end portion of said workpiece;

a grinding step for the other end portion to rotate said workpiece by rotating said driving pin of said spindle equipment at one side, and to grind the other end portion of said workpiece by sliding said swing slide with said grinding wheel at the other side faced to said workpiece in relative to said workpiece in a status that said driving pin of said spindle equipment at the other side facing to the grinding wheel is fixed at a position not to interfere with said faced grinding wheel;

a shifting step to the other direction to retract said swing slide with said grinding wheel at the other side from said workpiece, to stop the rotation of said driving pin of said spindle equipment at one side, and to shift simultaneously both of said centering members to the other side of said spindle rotational axis to a position where said driving pin of said spindle equipment at the other side can drive said workpiece and said driving pin of said spindle equipment at one side cannot drive said workpiece;

said shifting step to the other direction includes to rotate said driving pin of said spindle equipment at one side over 360 degrees at slower speed than that in grinding after stopping said rotation of said driving pin, and then again to stop said rotation of said driving pin in maintaining to contact said driving pin with said workpiece;

a facing step to said one grinding wheel to face said grinding wheel at one side to one end portion of said workpiece; and a grinding step to one end portion to rotate said workpiece by rotating said driving pin of said spindle equipment at the other side, and to grind one end portion of said workpiece by sliding said swing slide with said grinding wheel at the one side faced to said workpiece in relative to said workpiece in a status that said driving pin of said spindle equipment one side facing to the grinding wheel is fixed at a position not to interfere with said faced grinding wheel.

* * * * *